United States Patent [19]

Kellogg, deceased et al.

[11] 4,195,618

[45] Apr. 1, 1980

[54] FIREPLACE VENTING SYSTEM

[75] Inventors: John E. Kellogg, deceased, late of Northville, Mich., by Marian B. Kellogg and Nancy L. Lawson, heirs; by Rebecca J. Nagy, heir, Plymouth, Mich.

[73] Assignee: Larry Lawson, Northville, Mich.

[21] Appl. No.: 865,974

[22] Filed: Dec. 30, 1977

[51] Int. Cl.[2] ..... F24B 1/18; F24B 7/00

[52] U.S. Cl. ..... 126/120; 126/121; 126/139; 126/143; 237/51

[58] Field of Search ..... 126/120, 121, 143, 139; 237/51

[56] References Cited

U.S. PATENT DOCUMENTS

| | | | |
|---|---|---|---|
| 2,497,486 | 2/1950 | Barber | 126/120 |
| 3,180,332 | 4/1965 | Grushkin | 126/121 |
| 3,926,174 | 12/1975 | Bell | 126/121 |
| 4,026,263 | 5/1977 | Boyd | 126/121 |
| 4,064,864 | 12/1977 | Husa | 126/121 |

*Primary Examiner*—James C. Yeung
*Assistant Examiner*—Daniel J. O'Connor
*Attorney, Agent, or Firm*—Fisher, Gerhardt, Crampton & Groh

[57] ABSTRACT

A fireplace venting system wherein the opening to the combustion chamber is provided with a manifold extending across the top and at opposite sides of the opening. The manifold is provided with a plurality of holes which direct air delivered from the exterior of a building to be heated across the opening of the fireplace and into the combustion chamber to supply the combustion air and to isolate the fireplace combustion chamber so that heat is not lost from the room to be heated and so that smoke from the fireplace does not enter the room.

3 Claims, 4 Drawing Figures

FIREPLACE VENTING SYSTEM

This invention relates to fireplaces and more particularly to a fireplace with a separate air supply or venting system.

Most fireplaces are constructed in the wall of a room and draw the air necessary for combustion and for the draft in the chimney from the room itself. This not only causes a loss of heat from the room but under certain conditions smoke passes from the combustion chamber into the room rather than through the fireplace flue. Also the demand for combustion air and draft air causes air, usually cold, unheated air to be drawn into the room from the building exterior causing cold drafts.

It is an object of the invention to provide a fireplace wherein the air requirements for combustion and flue draft are supplied from a separate source and not from the room in which the fireplace is located.

It is another object of the invention to provide an air curtain around the fireplace opening which inhibits the loss of heat from the room and the passage of smoke from the combustion chamber to the room.

The objects of the invention are accomplished by a fireplace construction in which the fireplace is located in the wall of an area to be heated and has a combustion chamber opening into the area to be heated. The opening has a manifold located at its opposite sides and across the top which receives air from outside the area to be heated and delivers air through a plurality of holes to form a continuous air curtain extending across the opening. The air curtain acts to isolate the combustion chamber from the room to be heated and prevents heat from the room from passing up the flue of the chimney while at the same time the air from the air curtain supplies the combustion air requirements for the fire. The holes are distributed to form a continuous wall of air and are angled to be directed across the opening and at a slight angle into the combustion chamber.

These and other objects of the invention will be apparent from the following description and from the drawings in which FIG. 1 is a front elevation of a fireplace embodying the invention;

Figure 1:
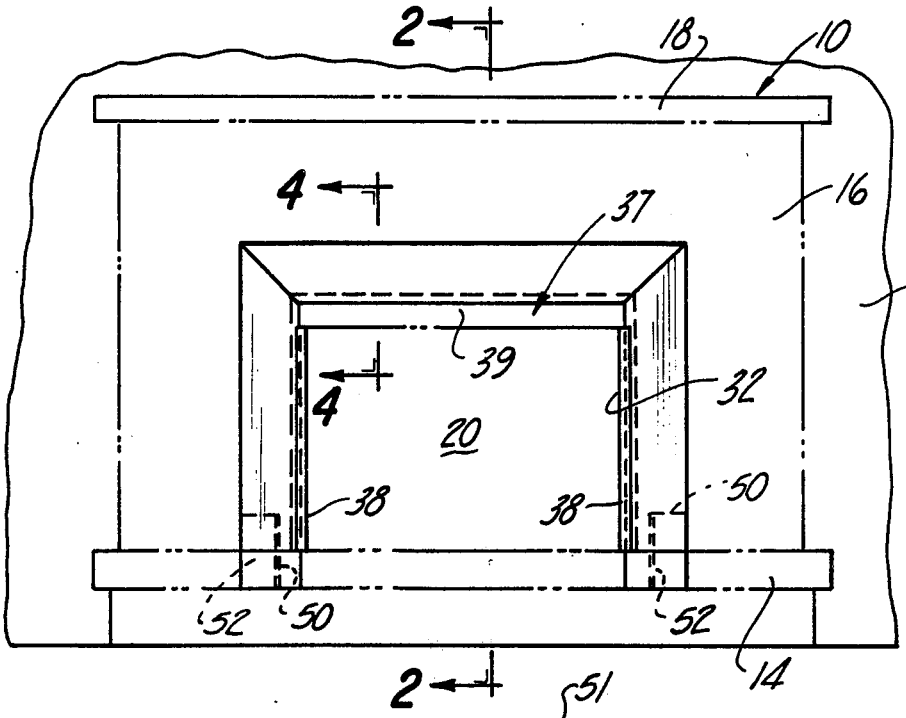
Figure 2:
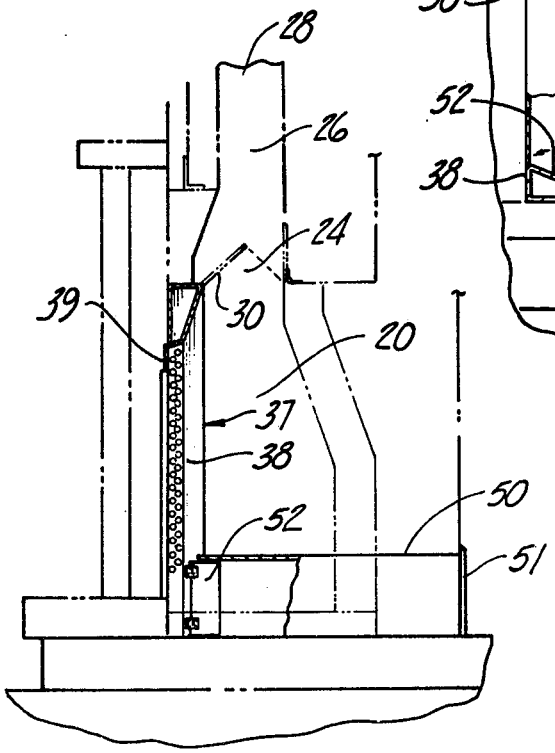
FIG. 2 is a cross sectional view taken on line 2—2 in FIG. 1.
Figure 3:
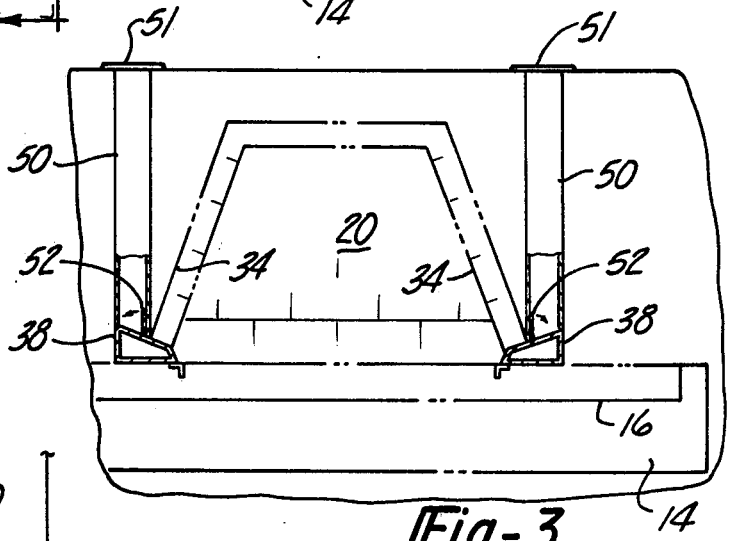
FIG. 3 is a top sectional view of the fireplace shown in FIGS. 1 and 2.

Referring to the drawings, a fireplace embodying the invention is designated generally at 10 and is illustrated as being built into a wall 12 of a room of a building. The fireplace 10 has an exterior hearth 14, a face 16 against the wall 12 and below a horizontally disposed mantle 18. The fireplace 10 includes a combustion chamber 20 with a floor or interior hearth 22. The combustion chamber 20 opens at its upper end through a throat area 24 to the flue 26 of a chimney 28. The throat 24 is under the control of a conventional damper 30. Typically when the fireplace is not in use the damper 30 is closed to prevent the escape of air from the interior of the building and when the fireplace is in use the damper 30 typically is open to its fully opened position. The combustion chamber 20 is open into the room through an opening 32 and the combustion chamber is formed with side walls 34 which can converge with each other and merge with a rear wall 36 parallel to the interior wall of the room or the face 16.

The opposite sides and upper edge of the opening 32 is framed with a manifold 37 which preferably is made of sheet metal and is hollow to convey air. The manifold 37 is generally in the form of an inverted U with vertical leg member 38 in parallel spaced relationship to each other and at opposite sides of the opening 32. The manifold 37 also includes an upper cross member 39 joined with and communicating with the upper ends of the vertical leg members 38.

Figure 4:
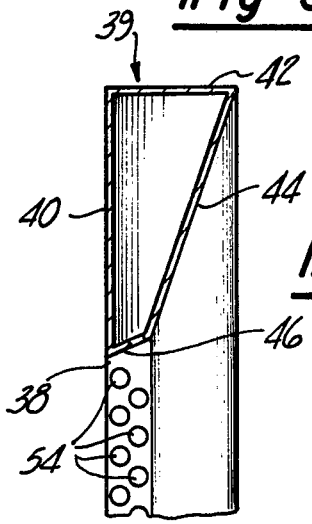
FIG. 4 is a cross sectional view at an enlarged scale.

As viewed in cross section in FIG. 4 the upper cross member 39 has a front wall 40 and an upper wall 42 formed at right angles to each other. The upper cross member 39 also has a rear wall 44 formed at an acute angle with the outer wall 42. The manifold 37 also has a lower, relatively narrow wall 46 formed at an acute angle with the front wall 40. Preferably the walls are disposed so that the angle between the walls 40 and 46 is approximately sixty-five degrees.

The legs 38 have a construction identical in cross section to the cross section of the upper cross member 39. The upper ends of the leg members 38 and the corresponding opposite ends of the cross member 39 are mitered and joined together to form a continuous air conduit or manifold. The lower ends of the legs 38 of the manifold 37 communicate by way of a pair of ducts 50 extending rearwardly through the wall 42 and to the exterior of the room. Preferably the ducts are arranged horizontally and their inlets indicated at 51 can be maintained permanently opened to the exterior of the room in which the fireplace is located. A damper or gate 52 is formed in each conduit or duct 50 to close the latter to the passage of air when the fireplace is not in use.

As best seen in FIG. 4, the leg members 38 have their walls 46 formed with a plurality of holes 54 to permit air to pass from the exterior of the room into the combustion chamber 20 of the fireplace 10. The holes 54 are uniformly spaced but are arranged in a staggered relationship which increases the area available for the delivery of air to the combustion chamber. The holes 54 are similarly arranged in the wall 46 of the cross member 39. The hole distribution is such that air from the inlets 51 is delivered through the holes 54 in a continuous wall or curtain around the top and sides of the opening 32 and is directed into the combustion chamber 20. This makes it possible to deliver a maximum amount of air from the manifold 37 to the combustion chamber 20 so that none of the fireplace air requirement need to be supplied from the room itself. Also the continuous flow of air forms a curtain which is directed slightly inwardly to the combustion chamber 20 to isolate the heat in the room and prevent it from escaping up the flue 26. Also the inwardly directed curtain of air insures that smoke passes up the flue 26 and not into the room. In actual practice it has been found that the distribution of the holes 54 in the manifold should be made as continuous as possible around the three sides of the opening 32 with edges of adjacent holes 54 horizontally aligned so that the air directed from the holes 54 forms a substantially uninterupted wall or curtain of air. Moreover it has been found that the total area of all of the holes 54 should be substantially equal to the smallest cross sectional area of the two ducts 50. Usually this will be found in the locality of the damper doors 52 which are used to close the ducts 50. Such a relationship insures a continuous flow of air through all of the holes 54 to supply the various requirements of the fireplace 10. Still another requirement for the holes 54 is that they be directed across the opening 32 and inwardly of the combustion chamber 20. By placing the inner walls 46 at an angle, the axes of the openings 54 in the leg members 38 are horizontal and angled inwardly while the axes of the holes 54 in the cross member 39 are angled downwardly and inwardly. As a practical matter it has been found that an angle of approximately thirty-five degrees with the face 16 of the fireplace is satisfactory.

A fireplace venting system has been provided in which a fireplace formed in a wall of a room to be heated has a manifold which receives air from the exterior of the room to be heated and delivers it through openings along the sides and top of the perimeter of the opening to the combustion chamber. In this manner air is delivered continuously from the exterior of the room to be heated through holes in the manifold which form an air curtain extending across the opening and angled slightly inwardly toward the combustion chamber. The distribution of the holes is such that the total area is equal to the smallest cross-sectional area of ducts conveying air from the air inlets to the manifold means to insure a steady and constant delivery of air.

The embodiments of the invention in which an exclusive property or privilege is claimed are defined as follows:

1. In a fireplace venting system, the combination of a combustion chamber, a rectangular opening between said combustion chamber and a space to be heated, an inverted U-shaped manifold means forming top and opposite sides of the perimeter of said opening, duct means delivering air to said manifold means from an air inlet disposed exterior to the space to be heated, a plurality of uniformly spaced holes in said manifold means at the top and at the sides of perimeter of said chamber opening, said holes in each of said sides and top being uniformly spaced with edges of adjacent holes in horizontal alignment with each other to provide a substantially continuous uninterrupted wall of air between said combustion chamber and the space to be heated, said duct means being substantially equal in cross sectional area to the total area of said holes, the bottom of the perimeter of said opening being inperforate, said space holes being operative to deliver air from said holes to provide a curtain of air at said opening to substantially isolate the space to be heated and said chamber from each other.

2. The combination of claim 1 wherein said manifold means forming said inverted U-shaped frame has legs each communicating through separate conduits forming said duct means to the exterior of the space to be heated.

3. The combination of claim 2 wherein said holes in the pair of legs are formed in walls disposed at an angle to the plane of said opening so that air is discharged in a path extending generally horizontally and converging into said chamber and the holes in the U-shaped portion joining the two legs are formed in another wall disposed at an angle to the plane of said opening so that air is discharged in a path directed inwardly and downwardly into said chamber.

* * * * *

UNITED STATES PATENT AND TRADEMARK OFFICE

CERTIFICATE OF CORRECTION

PATENT NO. : 4,195,618

DATED : April 1, 1980

INVENTOR(S) : John E. Kellogg, deceased

It is certified that error appears in the above-identified patent and that said Letters Patent are hereby corrected as shown below:

Column 2, line 5, "member" should read --members-- line 59, "uninterupted" should read --uninterrupted--.

Column 4, line 11, "inperforate" should read --imperforate--; "space" should read --spaced--;

line 16, cancel "manifold";

line 17, cancel "means forming said"; cancel "frame" and insert --manifold means--.

Signed and Sealed this

*Twenty-ninth* Day of *July 1980*

[SEAL]

*Attest:*

SIDNEY A. DIAMOND

*Attesting Officer*

*Commissioner of Patents and Trademarks*